US007958583B1

(12) United States Patent
Heffner

(10) Patent No.: US 7,958,583 B1
(45) Date of Patent: Jun. 14, 2011

(54) THREAD REMOVAL DEVICE

(76) Inventor: Lorri L. Heffner, Houston, TX (US)

( * ) Notice: Subject to any disclaimer, the term of this patent is extended or adjusted under 35 U.S.C. 154(b) by 14 days.

(21) Appl. No.: 12/566,367

(22) Filed: Sep. 24, 2009

Related U.S. Application Data

(60) Provisional application No. 61/107,094, filed on Oct. 21, 2008.

(51) Int. Cl.
*B26B 27/00* (2006.01)
*B25F 1/00* (2006.01)

(52) U.S. Cl. ..... 7/158; 7/121

(58) Field of Classification Search ..... 7/158, 121, 7/118, 169; D8/16, 98; D3/18; D28/55; 30/294
See application file for complete search history.

(56) References Cited

U.S. PATENT DOCUMENTS

| | | | | |
|---|---|---|---|---|
| D199,564 | S * | 11/1964 | Koss | D8/98 |
| 5,015,252 | A * | 5/1991 | Jones | 7/118 |
| D351,059 | S * | 10/1994 | Kahlcke | D3/18 |
| 2001/0033486 | A1 * | 10/2001 | Maine | 362/119 |

OTHER PUBLICATIONS

Photograph of Combicut at http://asatsuru.com/catalog/images/Hoechstmass/combicut_2_tips.jpg.
Photograph of perspective view of a Combicut with a thread cutting portion extended from one end thereof. A thread grabbing portion cannot be extended from the other end, when the thead cutting portion is extended.
Photograph of a top view of a Combicut with a thread grabbing portion extended from the other end thereof, a thread cutting portion cannot be extended, when the thread grabbing portion is extended.

* cited by examiner

*Primary Examiner* — Hadi Shakeri
(74) *Attorney, Agent, or Firm* — Donald J. Ersler

(57) ABSTRACT

A thread removal device preferably includes a thread cutter, a grasping implement and a finger base. The thread cutter preferably includes a blade projection and a safety projection extending from a cutter base. A cover cap may be placed over the thread cutter. The grasping implement includes a first grasping leg and a second grasping leg. A first contact pad is formed on one end of first grasping leg and a second contact pad is formed on one end of the second grasping leg. The first and second contact pads are biased away from each other. The other ends of the first and second grasping legs receive cutter base. The first grasping leg, the second grasping leg and the thread cutter may be attached to each other with any suitable assembly method. The finger base may be retained over grasping implement and the thread cutter.

18 Claims, 3 Drawing Sheets

THREAD REMOVAL DEVICE

CROSS-REFERENCES TO RELATED APPLICATIONS

This is a nonprovisional application taking priority from provisional application No. 61/107,094, filed on Oct. 21, 2008.

BACKGROUND OF THE INVENTION

1. Field of the Invention

The present invention relates generally to removing threads from a sewn article and more specifically to a thread removal device, which reduces the challenges associated with seam ripping.

2. Discussion of the Prior Art

A sewer, who wishes to remove unwanted threads from a sewn seam needs a sharp instrument to cut through the threads to remove them from the sewn article. The sewer removing the thread will oftentimes use a universal seam ripper. A universal seam ripper has the nuisance value of not offering a thread removal feature. The universal seam ripper cuts the thread and leaves thread remnants, yet, the thread remnants still need to be removed. Many times sewers will attempt to use their fingers to grasp these threads and pull them out. The sewer may also use a grasping tool, such as tweezers to remove the thread remnants. It is inconvenient and time consuming to use two separate tools consecutively. Further, two separate tools require that the eyes and hands are constantly going from the first tool to the second tool.

Accordingly, there is a clearly felt need in the art for a thread removal device, which includes a thread cutter for cutting threads on one end and a grasping implement to remove the cut threads at the other end.

SUMMARY OF THE INVENTION

The present invention provides a thread removal device, which reduces the challenges associated with seam ripping. The thread removal device preferably includes a thread cutter, a grasping implement and a finger base. The thread cutter preferably includes a blade projection, a safety projection and a cutter base. The blade projection and the safety projection extend from one end of the cutter base to form a substantial Y-shape. A web surface of the blade projection is sharpened for cutting threads.

An end of the blade projection preferably comes to a point for insertion under a thread. The safety projection protects a user from cutting themselves or the sewn article they are working on. It is preferable to terminate an end of the safety projection with a safety cap. A cover cap may be used to protect an end of the thread cutter.

The grasping implement includes a first grasping leg and a second grasping leg. A first contact pad is preferably formed on one end of first grasping leg and a second contact pad is formed on one end of the second grasping leg. The first and second contact pads allow a thread remnant to be grasped from a sewn article. The first and second contact pads are biased away from each other by fabricating the first and second grasping legs from resilient material, such as spring steel.

A first base recess is formed in the other end of the first grasping leg and a second base recess is formed in the other end of the second grasping leg. The first and second base recesses are sized to receive the cutter base. The first grasping leg, the second grasping leg and the thread cutter may be attached to each other by welding, adhesive or any suitable assembly method. The finger base may be retained over a portion of the first grasping leg, the second grasping leg and the thread cutter. The finger base includes an outer perimeter that may be grasped and retained by a thumb and forefinger.

Accordingly, it is an object of the present invention to provide a thread removal device, which includes a thread cutter for cutting threads on one end and a grasping implement for removing thread remnants on the other end.

Finally, it is another object of the present invention to provide a thread removal device, which has the unexpected result of not requiring a sewer to remove their eye focus from sewing work, while cutting threads and removing the thread remnants.

These and additional objects, advantages, features and benefits of the present invention will become apparent from the following specification.

DETAILED DESCRIPTION OF THE PREFERRED EMBODIMENTS

Figure 1:
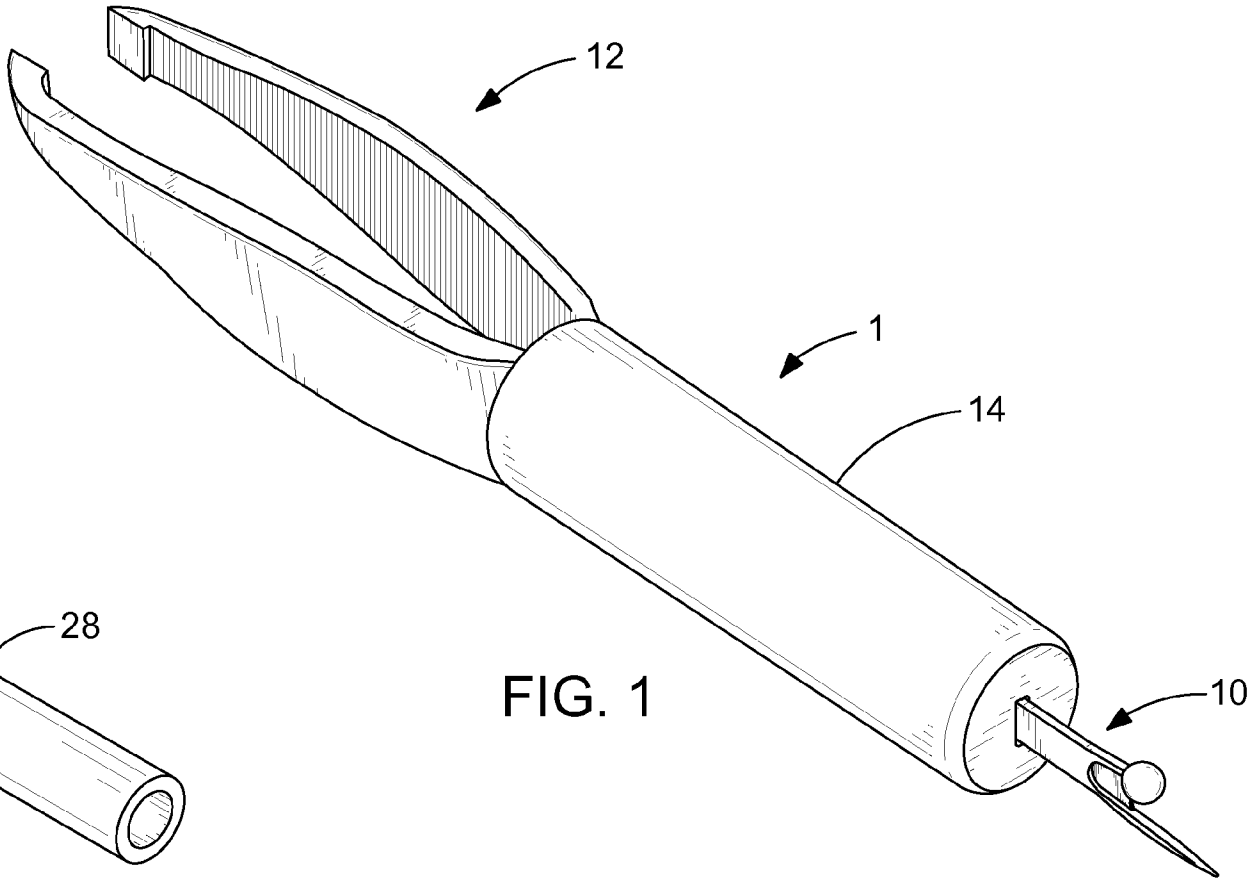
FIG. 1 is a perspective view of a thread removal device in accordance with the present invention.
Figure 4:
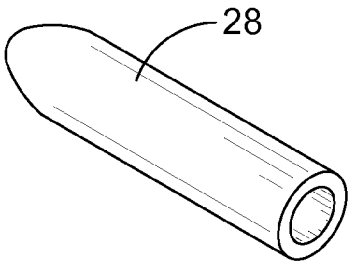
FIG. 4 is a perspective view of a cover cap for protecting a thread cutter of a thread removal device in accordance with the present invention.
Figures 2, 3:
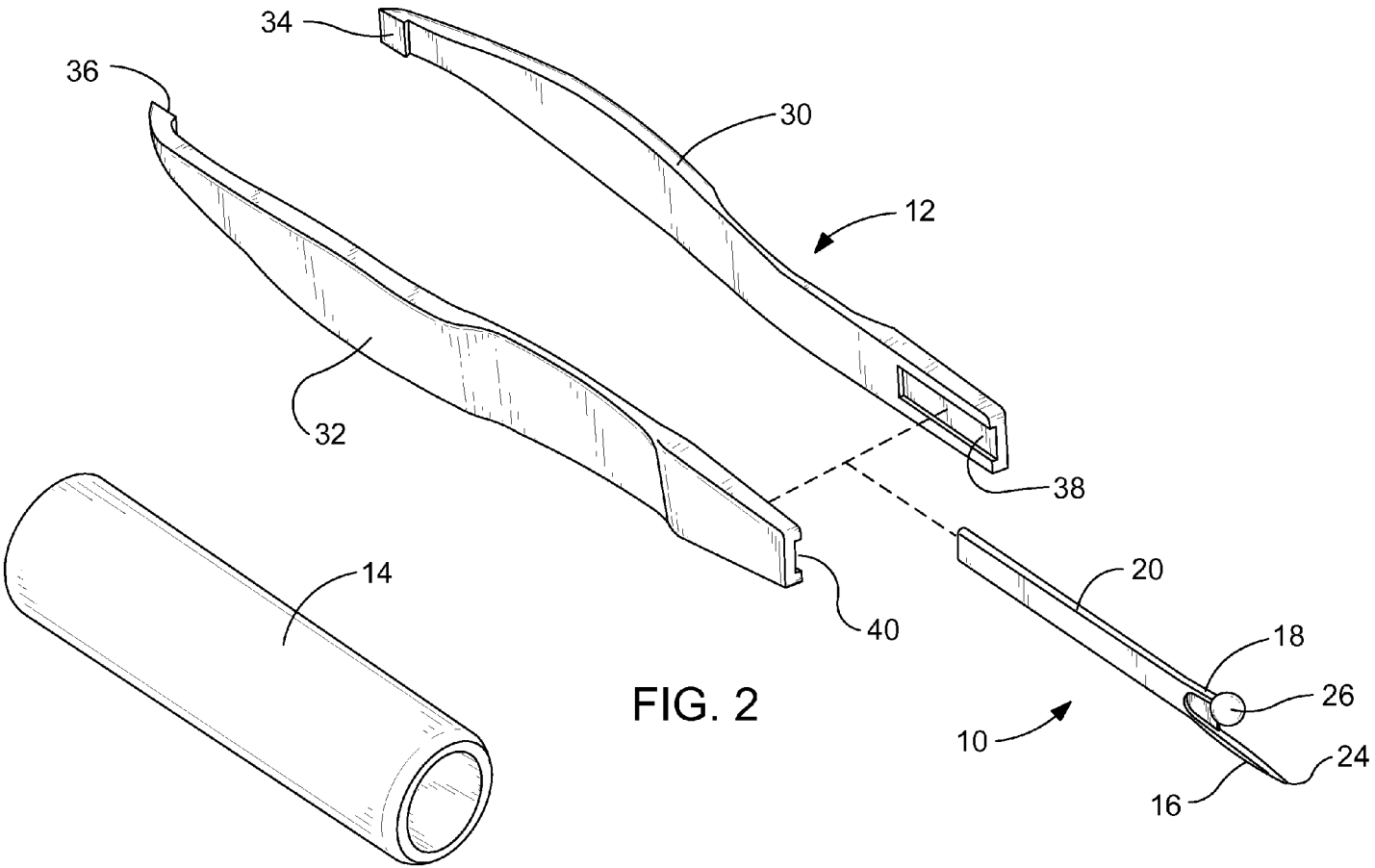
FIG. 2 is an exploded perspective view of a thread removal device without a finger base in accordance with the present invention.
FIG. 3 is a perspective view of a finger base of a thread removal device in accordance with the present invention.
Figure 5:
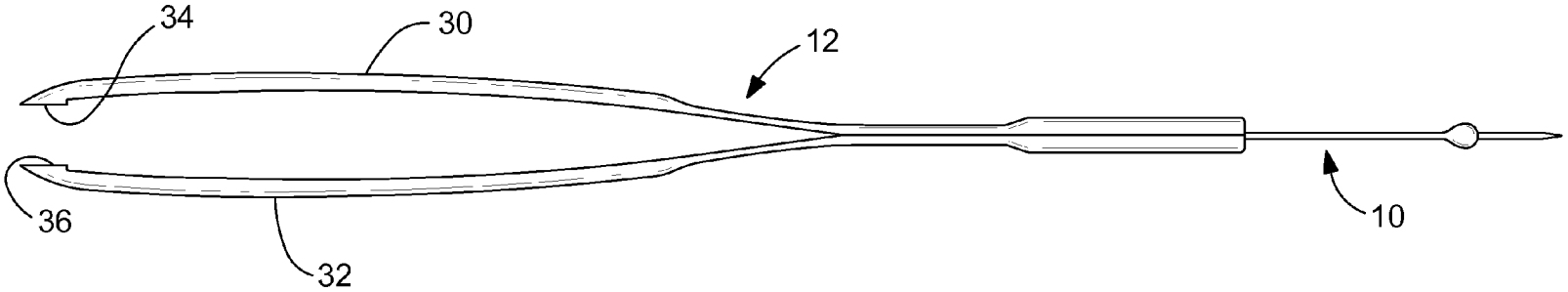
FIG. 5 is a top view of a thread removal device without a finger base in accordance with the present invention.
Figure 6:
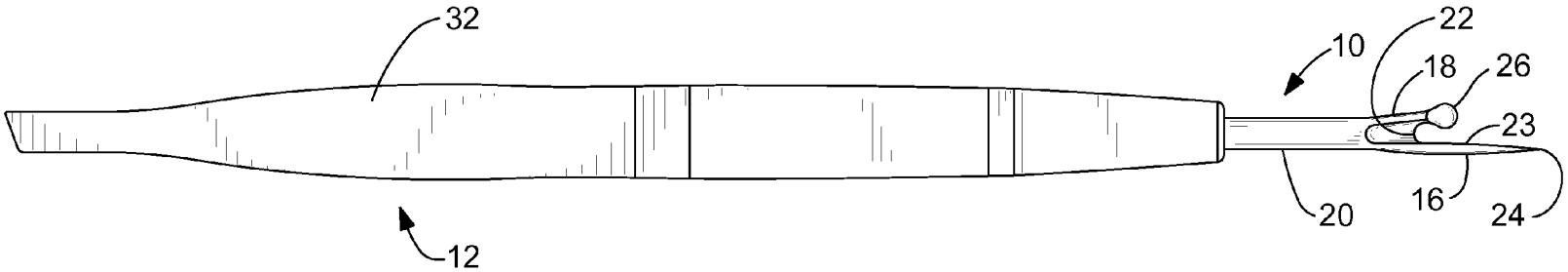
FIG. 6 is a side view of a thread removal device without a finger base in accordance with the present invention.

With reference now to the drawings, and particularly to FIG. 1, there is shown a perspective view of a thread removal device 1. With reference to FIGS. 2-6, the thread removal device 1 preferably includes a thread cutter 10, a grasping implement 12 and a finger base 14. The thread cutter 10 preferably includes a blade projection 16, a safety projection 18 and a cutter base 20. The blade projection 16 and the safety projection 18 extend from one end of the cutter base 20 to form a substantial Y-shape.

A web area 22 between the blade projection 16 and the safety projection 18 is sharpened for cutting threads. However, substantially all of the inside surface 23 of the blade projection may also be sharpened. An end of the blade projection 16 preferably comes to a point 24 for insertion under a thread. The safety projection 18 protects a user from cutting themselves or a sewn article they are working on. It is preferable to terminate an end of the safety projection 18 with a safety cap 26. A cover cap 28 may be used to protect an end of the thread cutter 10.

The grasping implement 12 includes a first grasping leg 30 and a second grasping leg 32. A first contact pad 34 is preferably formed on one end of first grasping leg 30 and a second contact pad 36 is formed on one end of the second grasping leg 32.

The first and second contact pads allow a thread remnant to be grasped from a sewn article. The first and second contact pads are biased away from each other by fabricating the first and second grasping legs from resilient material, such as spring steel.

A first base recess 38 is formed in the other end of the first grasping leg 30 and a second base recess 40 is formed in the other end of the second grasping leg 32. The first and second base recesses are sized to receive the cutter base 20. The other end of the first grasping leg 30, the second grasping leg 32 and the thread cutter 10 may be attached to each other by welding, adhesive or any suitable assembly method. An optional finger base 14 may be retained over a portion of the first grasping leg 30, the second grasping leg 32 and the thread cutter 10. The finger base 14 may be molded over the thread cutter 10 and the grasping implement 12 or pre-molded and slipped over the thread cutter 10 and the grasping implement 12. The finger base 14 includes an outer perimeter, which is shaped, roughened and/or fabricated from a suitable material to facilitate a secure grasp between the thumb and forefinger.

During use, a user cuts a thread with the thread cutter 10 and rotates or twirls the thread removal device 1 in their hand without removing their eye focus from the sewn article and removes the thread remnant(s) with the grasping implement 12.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A thread removal device comprising:

a thread cutter having a cutter base and a blade projection extending from said cutter base;

a first grasping leg having a first pad formed on an inner surface of one end of said first grasping leg, a first base slot is formed on said inner surface of the other end of said first grasping leg, said first base slot is sized to receive said cutter base; and a second grasping leg having a second pad formed on an inner surface of one end of said second grasping leg, a second base slot is formed on said inner surface of the other end of said second grasping leg, said second base slot is sized to receive said cutter base, said one end of said first and second grasping legs being biased away from each other, the other end of said first and second grasping legs being attached to said cutter base.

2. The thread removal device of claim 1, further comprising:

a safety projection and said blade projection extend from the said cutter base to form a substantial Y-shape.

3. The thread removal device of claim 2, further comprising:

said safety projection being terminated with a safety cap.

4. The thread removal device of claim 2, further comprising:

a cover cap for covering said blade projection and said safety projection.

5. The thread removal device of claim 1 wherein:

said blade projection being terminated with a point.

6. The thread removal device of claim 1, further comprising:

a finger base being formed over a portion of said cutter base, said first grasping leg and said second grasping leg.

7. A thread removal device comprising:

a thread cutter having a cutter base and a blade projection extending from said cutter base;

a first grasping leg having a first pad formed on an inner surface of one end of said first grasping leg, a first base slot is formed on said inner surface of the other end of said first grasping leg, said first base slot is sized to receive said cutter base; and a second grasping leg having a second pad formed on an inner surface of one end of said second grasping leg, a second base slot is formed on said inner surface of the other end of said second grasping leg, said second base slot is sized to receive said cutter base, said one end of said first and second grasping legs being biased away from each other, the other end of said first and second grasping legs being attached to said cutter base, an end of said first pad having an acute angle with a length of said first grasping leg, an end of said second pad having an acute angle with a length of said second grasping leg.

8. The thread removal device of claim 7, further comprising:

a safety projection and said blade projection extend from the other end of said cutter base to form a substantial Y-shape.

9. The thread removal device of claim 8, further comprising:

said safety projection being terminated with a safety cap.

10. The thread removal device of claim 8, further comprising:

a cover cap for covering said blade projection and said safety projection.

11. The thread removal device of claim 7 wherein:

said blade projection being terminated with a point.

12. The thread removal device of claim 7, further comprising:

a finger base being formed over a portion of said cutter base, said first grasping leg and said second grasping leg.

13. A thread removal device comprising:

a thread cutter having a cutter base and a blade projection extending from said cutter base, said cutter base having a rectangular cross section;

a first grasping leg having a first pad formed on an inner surface of one end of said first grasping leg, a first rectangular base slot is formed on said inner surface of the other end of said first grasping leg, said first rectangular base slot is sized to receive said cutter base;

a second grasping leg having a second pad formed on an inner surface of one end of said second grasping leg, a second rectangular base slot is formed on said inner surface of the other end of said second grasping leg, said second rectangular base slot is sized to receive said cutter base, said one end of said first and second grasping legs being biased away from each other, the other end of said first and second grasping legs being attached to said cutter base, an end of said first pad having an acute angle with a length of said first grasping leg, an end of said second pad having an acute angle with a length of said second grasping leg; and a finger base being formed over a portion of said cutter base, said first grasping leg and said second grasping leg.

14. The thread removal device of claim 13 wherein:

said blade projection being terminated with a point.

15. The thread removal device of claim 13, further comprising:

said safety projection being terminated with a safety cap.

16. The thread removal device of claim 13, further comprising:

a cover cap for covering said blade projection and said safety projection.

17. The thread removal device of claim 13, further comprising:

a first pad being formed on the one end of said first grasping leg, a second pad being formed on the one end of said second grasping leg.

18. The thread removal device of claim 13, further comprising:

a safety projection and said blade projection extend from the said cutter base to form a substantial Y-shape.

* * * * *